US006966078B2

(12) United States Patent
Evans et al.

(10) Patent No.: US 6,966,078 B2
(45) Date of Patent: Nov. 22, 2005

(54) SKIMMER SEAL

(75) Inventors: Cliff Evans, Newtown, CT (US); Mark W. Dalton, Danbury, CT (US)

(73) Assignee: Namco, LLC, Manchester, CT (US)

( * ) Notice: Subject to any disclaimer, the term of this patent is extended or adjusted under 35 U.S.C. 154(b) by 302 days.

(21) Appl. No.: 10/613,127

(22) Filed: Jul. 3, 2003

(65) Prior Publication Data

US 2005/0000009 A1 Jan. 6, 2005

(51) Int. Cl.[7] ..... E04H 4/00
(52) U.S. Cl. ..... 4/496; 4/507; 4/510
(58) Field of Search ..... 4/490, 496, 507, 4/508, 510, 512, 293; 210/169, 242.1, 416.2; 220/378, 241, 793

(56) References Cited

U.S. PATENT DOCUMENTS 4,903,351 A 2/1990 Dengel et al.
4,913,810 A * 4/1990 Hodak ..... 4/496
5,285,538 A 2/1994 Hodak
5,604,939 A * 2/1997 Widener ..... 4/507
5,937,453 A * 8/1999 Hodak et al. ..... 4/508

OTHER PUBLICATIONS

WinterCover.com—Aquador Skimmer Closure System.

* cited by examiner

*Primary Examiner*—Tuan Nguyen
(74) *Attorney, Agent, or Firm*—Pepe & Hazard, LLP

(57) ABSTRACT

A winterizing seal for a pool skimmer includes a cover plate dimensioned to overlap the margins of the skimmer opening and having a support portion on its rear surface which extends into the skimmer passageway. A resiliently deformable gasket is provided on the support portion and is configured and dimensioned to bear on the side walls of the skimmer passageway to provide a leak-proof seal between the cover plate and the skimmer passageway. The gasket is pressed against the side walls of the skimmer passageway by a compression plate which is coupled to the cover plate by a nut.

12 Claims, 5 Drawing Sheets

SKIMMER SEAL

BACKGROUND OF THE INVENTION

The present invention relates generally to skimmers for swimming pools and spas.

Conventional swimming pool filtration systems include a skimmer for removing floating debris from the surface of the water. The skimmer typically includes a skimmer mouth or opening in the pool wall adjacent the top surface of the water. The opening is connected to a passageway which extends through the pool wall to a filtration basket which catches large particles such as leaves, thereby removing them from the pool and keeping them from the water re-circulation lines. Water which exits the pool through the skimmer passageway subsequently is drawn into the main filter in order to remove small particles. The filtered water is then re-circulated back into the pool through return lines.

When closing a pool for the winter, it is important to empty the skimmer to prevent damage due to freezing. One method of emptying the skimmer is by draining the pool until the water level is below the lower edge of the skimmer mouth or opening. Another technique is to cover the opening into the skimmer, thereby preventing the entry of water, and then draining any remaining water from the skimmer line. When a cover is used, it must be leak-proof over a broad range of ambient temperatures.

Some prior known cover assemblies for pool skimmers require a specific type of face plate to be installed over the skimmer opening. A cover is then removably mounted over the peripheral edge of the face plate. It would be useful to develop a skimmer seal which provides for water-tight sealing of the skimmer opening and does not require use of a specific type of face plate.

It is an object of the present invention to provide a novel skimmer seal that will prevent ice damage to the skimmer and avoid requiring the water level of the pool to be reduced when the pool is winterized.

A further object is to provide such a skimmer seal that can be installed and removed quickly and easily.

Another object is to provide a seal which can be used on skimmers that do not have face plates.

A further object is to provide a sea and which can be adapted for some variation in the dimensioning of the flow passage.

A further object is to provide a seal that can be installed and removed from a skimmer without tools.

SUMMARY OF THE INVENTION

It has now been found that the foregoing and related objects may be readily attained in a novel winterizing seal for a pool skimmer having a housing with an opening thereinto and a passageway extending therethrough. The seal includes a cover plate dimensioned and configured to cover the opening and having a support portion dimensioned to extend through the opening and into the passageway. Resiliently deformable sealing means extends about and is mounted on the cover plate support portion, and pressing means presses on the sealing means to effect deformation thereof into sealing contact with the passageway side walls of the skimmer to provide a water resistant seal between the cover plate and the skimmer passageway.

Preferably, the pressing means includes a compression plate dimensioned and configured to provide a peripheral portion which bears on the sealing means to press it outwardly toward the side walls of the skimmer passageway, and means for coupling the cover plate and compression plate.

The sealing means is a gasket and the compression plate includes a rib configured to bear against the gasket. Desirably, the gasket and the rib have cooperating beveled surface portions, and the gasket support portion is configured to support gaskets of different thicknesses.

The skimmer/seal assembly comprises a skimmer having a skimmer opening and a skimmer passageway extending therethrough from the pool opening and having side walls. The winterizing seal is removably mounted in the skimmer passageway, and includes a cover plate dimensioned and configured to cover the skimmer opening and having a support portion extending through the opening and into the passageway. Resiliently deformable sealing means is mounted on and extends about the cover plate support portion, and pressing means presses on the sealing means to effect deformation thereof into sealing contact with the side walls of the skimmer passageway to provide a water resistant seal between the cover plate and the skimmer passageway.

DETAILED DESCRIPTION OF THE PREFERRED EMBODIMENT

Figure 1:
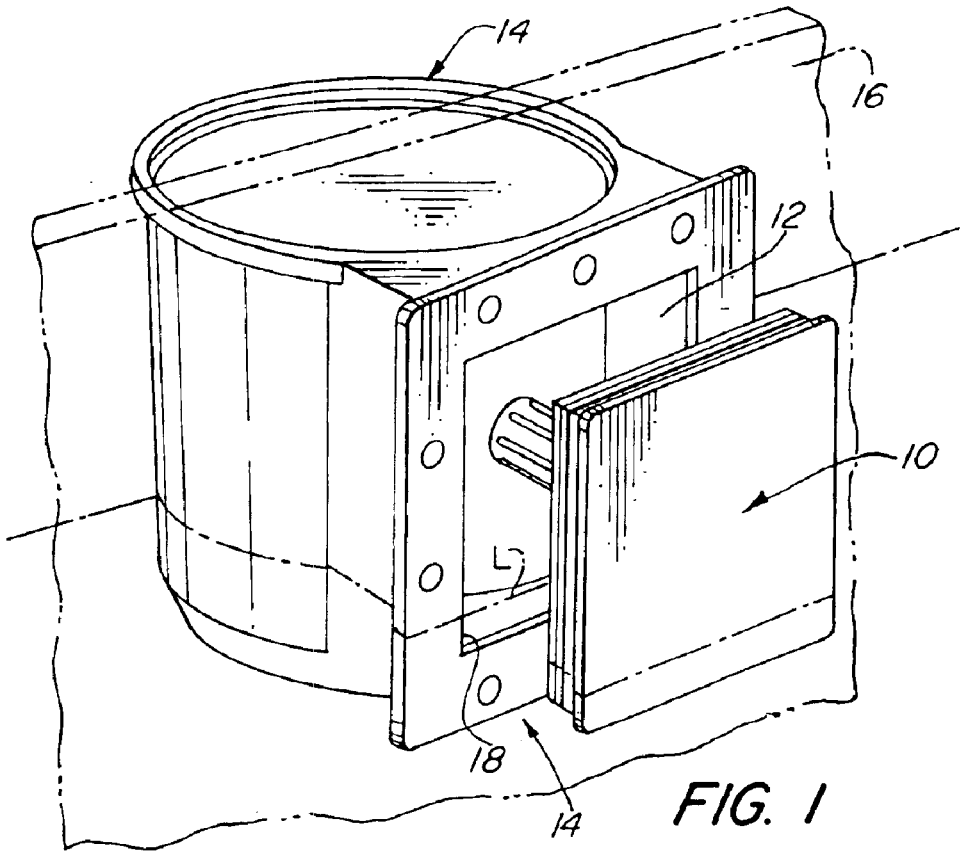
FIG. 1 is a fragmentary perspective view of a pool shown in phantom line with a skimmer and a seal embodying the present invention to be mounted in the pool skimmer passageway.
Figure 2:
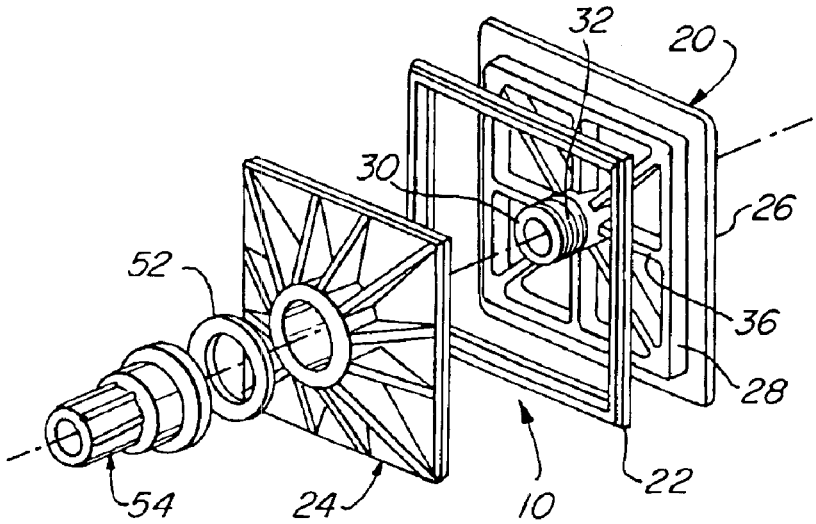
FIG. 2 is an exploded rear perspective view of the seal.

Turning first to FIGS. 1 and 2 of the attached drawings, therein illustrated is a skimmer seal embodying the present invention, and generally designated by the numeral 10. The seal 10 is mounted in the passageway 12 of the skimmer 14 which is mounted on the vertical wall 16 of the fragmentarily illustrated pool. The seal 10 is installed when the pool is winterized to prevent water from entering the skimmer passageway 12 through the opening 18 on the outer face of the skimmer 14.

The water level L in the pool is usually slightly above the lower edge of the skimmer opening 18. When the seal 10 is installed in the skimmer passageway 12, it resiliently presses against the side walls and into the corners of the skimmer passageway 12. This results in a faster and cleaner installation of a skimmer seal as compared with prior known covers which, as mentioned above, typically are mounted on the surface of a face plate which extends about the skimmer opening 18. The seal 10 can be used on skimmers for both in-ground and above ground pools, and can be used with skimmers that do not include face plates.

Figure 3:
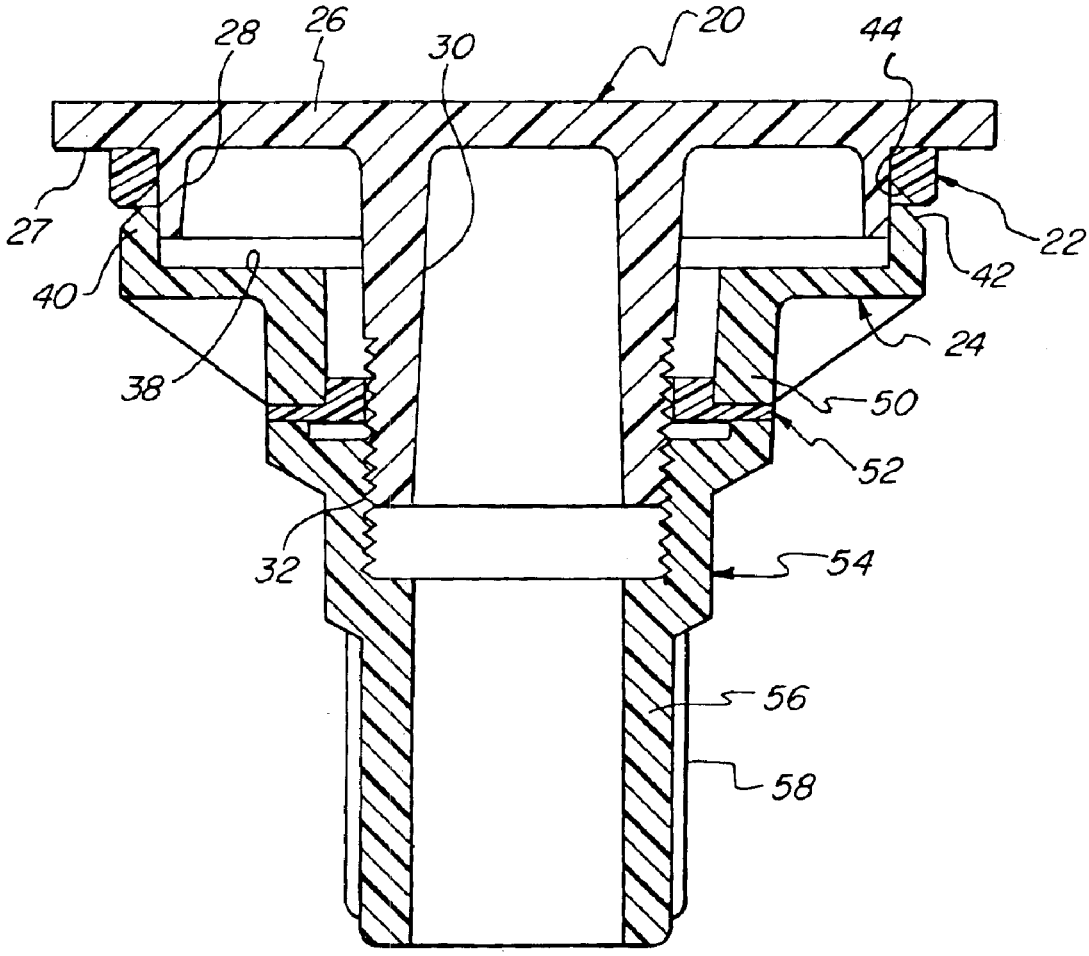
FIG. 3 is a cross sectional view of the seal drawn to an enlarged scale.

Referring now to FIGS. 2 and 3, the seal 10 includes a cover plate generally designated by the numeral 20 which is dimensioned and configured to cover the rectangular skimmer opening 18, and it supports a peripheral sealing gasket 22 and a compression plate generally designated by the numeral 24. The plates 20, 24 are secured in assembly by the nut generally designated by the numeral 54.

Figure 4:
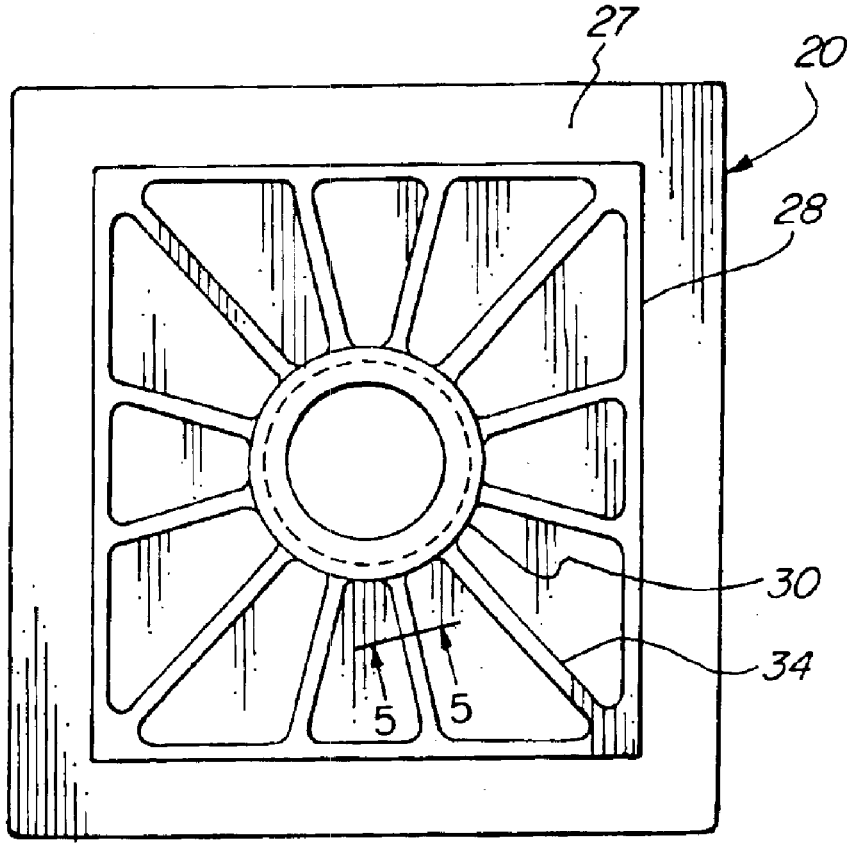
FIG. 4 is a rear view of the cover plate.
Figure 5:
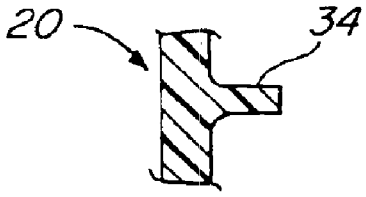
FIG. 5 is a sectional view of a cover plate rib taken along line 5—5 of FIG. 4.
Figure 7:
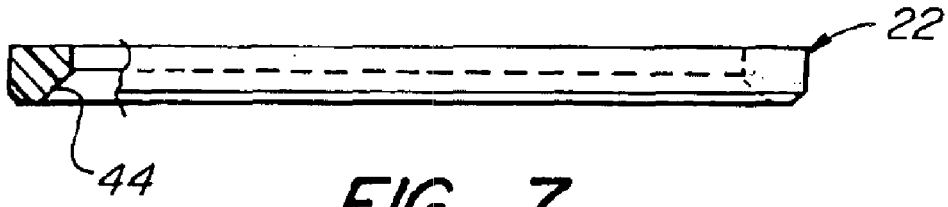
FIG. 7 is a side view of the gasket, in partial section.
Figure 6:
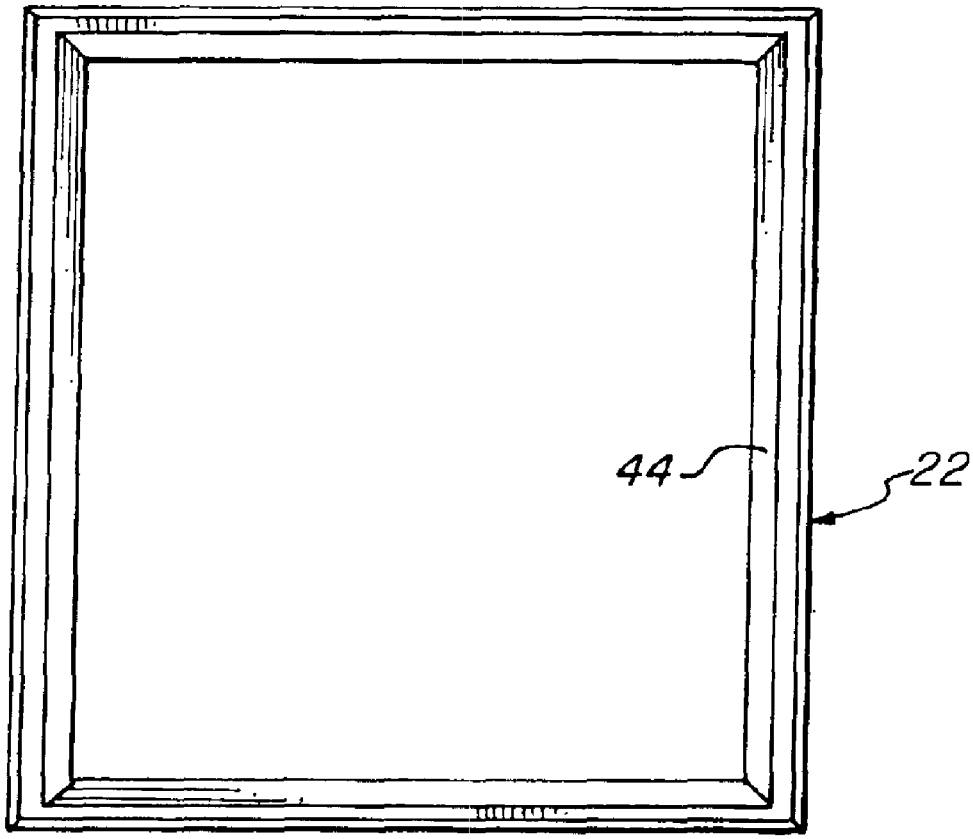
FIG. 6 is a rear elevational view of the sealing gasket.
Figure 9:
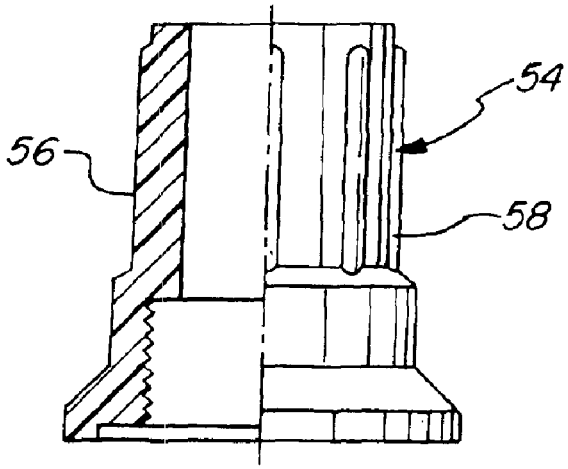
FIG. 9 is a side elevational view of the nut, in partial section.

The cover plate 20, as shown in FIGS. 3–5, includes a front wall portion 26 which is dimensioned to extend beyond the margins of the skimmer opening 18. A planar peripheral rear surface 27 abuts either the outer surface of the skimmer 14, or the area of the pool wall around the skimmer opening 18 (if the skimmer has no face plate). A rectangular gasket support portion 28 extends rearwardly from the rear surface and seats the gasket 22 on its outer periphery. The outer wall of the gasket support portion 28 corresponds to the configuration of the skimmer passageway 12, but has slightly smaller horizontal and vertical dimensions.

A generally cylindrical barrel portion 30 extends rearwardly from the center of the rear surface, and it has an externally threaded portion 32 at the inner end thereof. The rear surface of the cover plate 20 has a multiplicity of ribs 34 extending radially outwardly from the barrel portion 30 to the gasket support portion 28 in a sunburst pattern to strengthen the cover plate 20 and its gasket support portion 28 and the barrel portion 30.

Figure 8:
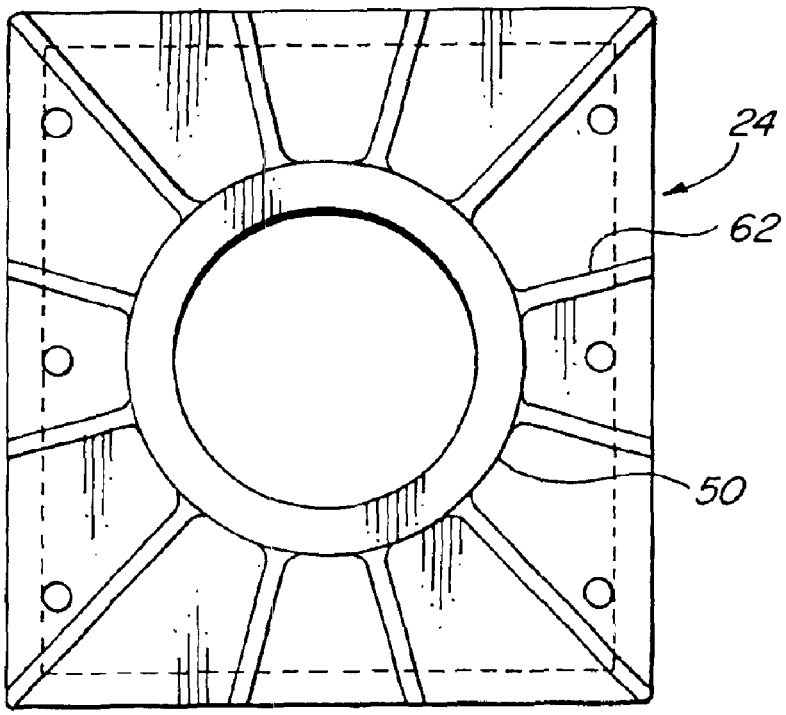
FIG. 8 is a rear view of the compression plate.

The compression plate 24 is shown in FIGS. 2, 3 and 8, and includes a rectangular plate portion 38 with a peripheral rib 40 extending forwardly from its front face. The end 42 of the rib 40 has an outwardly beveled edge which bears against the cooperatively beveled rear inner end 44 of the gasket 22. This configuration results in the gasket 22 being pushed both outwardly and forwardly by the compression plate 24 and provides a water-tight seal between the gasket 22 and the walls of the skimmer passageway 12. The rear surface of the compression plate 24 has radial ribs 62 thereon for strengthening.

Extending rearwardly from the plate portion 38 is a generally cylindrical flange 50 upon which is seated a generally annular washer 52. The barrel portion 30 of the cover plate 20 extends through the passage in the flange 50 and the washer 52. Threadably engaged on the threaded barrel portion 30 of the cover plate 20 is an internally threaded nut generally designated by the numeral 54, and it bears against the washer 50 and thereby the compression plate 24 to press it towards the cover plate 20. The nut 54 has a barrel portion 56 which has axial ribs 58 thereon to facilitate gripping, and a collar 60 which bears against the washer 50.

Preferably, the gasket 22 is removably mounted on the gasket support portion 28 of the cover plate 20 so that it can be replaced when necessary. Moreover, gaskets having different thicknesses can be used with the same cover plate 20 to accommodate some variation in the dimensions of the passageway 12.

The gasket typically is formed in one piece from a resiliently deformable synthetic resin that will retain its resiliency over a broad temperature range such as BDS and EPDM.

The compression plate and cover plate are molded in one piece from a durable, relatively hard, synthetic resin such as polyethylene, polypropylene, ABS and polyamides.

In order to install the seal the cover plate is provided with an appropriately sized gasket is lightly coated with a film of vegetable oil. The gasket is placed on the gasket support portion of the cover plate. Subsequently, the compression plate is placed against the gasket with the barrel portion extending through the compression plate. The washer is positioned at the end of the compression plate, and the nut is loosely threaded onto the threaded portion of the barrel portion of the cover plate. The weir plate (not shown) is removed from the skimmer, and the seal is then placed in the skimmer passageway with the peripheral portion 27 of the rear surface of the cover plate 20 abutting the skimmer flange or face plate (or the area of the pool wall surrounding the skimmer opening if no face plate is used). The nut 54 is then tightened by reaching into the skimmer access hole in the top of the skimmer while holding the cover plate 20 in place from the pool side. As the nut 54 is tightened, the compression plate 24 presses the gasket 22 forwardly and outwardly toward the side walls of the skimmer passageway 12 and into the corners to provide a water-tight seal between the skimmer passageway and the cover plate 20. After the seal 10 has been securely mounted in place, the skimmer line is drained for winterization. The water level in the pool is not reduced and water therefore contacts the front surface of the cover plate When the pool is re-opened, the cover plate is simply removed from the skimmer opening by partially loosening the nut and pushing the seal out of the skimmer opening 12.

Thus, the seal of the present invention seals the skimmer quickly and economically, and provides for fast and simple unsealing of the skimmer in the spring.

Having thus described the invention, what is claimed is:

1. A winterizing seal for a pool skimmer having a housing with an opening thereinto and a passageway extending therethrough, said seal comprising:

(a) a cover plate dimensioned and configured to cover the opening and having a support portion dimensioned to extend through the opening and into the passageway to prevent water flow through the skimmer passageway;

(b) resiliently deformable sealing means extending about and mounted on said cover plate support portion; and (c) means pressing on said sealing means to effect deformation thereof into sealing contact with the passageway side walls of the skimmer to provide a water resistant seal between said cover plate and the skimmer passageway.

2. The seal in accordance with claim 1 wherein said pressing means includes a compression plate dimensioned and configured to provide a peripheral portion which bears on said sealing means to press it outwardly toward the side walls of the skimmer passageway.

3. The seal in accordance with claim 2 further including means for coupling said cover plate and compression plate.

4. The seal in accordance with claim 2 wherein said sealing means is a gasket and said compressing plate includes a rib configured to bear against said gasket.

5. The seal in accordance with claim 4 wherein said gasket and said rib have cooperating beveled surface portions.

6. The seal in accordance with claim 4 wherein said gasket support portion is configured to support gaskets of different thicknesses.

7. A skimmer/seal assembly comprising:

(a) a skimmer having a skimmer opening and a skimmer passageway extending therethrough from said pool opening, said passageway having side walls; and (b) a winterizing seal removably mounted in said skimmer passageway, said seal including (i) a cover plate dimensioned and configured to cover said skimmer opening and having a support portion extending through the opening and into said passageway, (ii) resiliently deformable sealing means mounted on and extending about said cover plate support portion, and (iii) pressing means pressing on said sealing means to effect deformation thereof into sealing contact with said side walls of said skimmer passageway to provide a water resistant seal between said cover plate and said skimmer passageway.

8. The skimmer/seal assembly in accordance with claim 7 wherein said pressing means includes a compression plate dimensioned and configured to provide a peripheral portion which bears on said sealing means to press it outwardly toward the side walls of the skimmer passageway.

9. The seal in accordance with claim 8 including coupling means for coupling said cover plate and compression plate.

10. The seal in accordance with claim 9 wherein said sealing means is a gasket and said compression plate includes a rib configured to bear against said gasket.

11. The seal in accordance with claim 10 wherein said gasket and said rib have cooperating beveled surface portions.

12. The seal in accordance with claim 7 wherein said gasket support portion is configured to support gaskets of different thickness.

* * * * *